US005803096A

United States Patent [19]

Lee

[11] Patent Number: 5,803,096

[45] Date of Patent: Sep. 8, 1998

[54] HAIR CLIP

[76] Inventor: Ya Chung Lee, No. 42, Lane 3, Li Te 8th Road, Tainan City, Taiwan

[21] Appl. No.: 998,581

[22] Filed: Dec. 29, 1997

[51] Int. Cl.[6] ..... A45D 8/20

[52] U.S. Cl. ..... 132/277; 132/276; 132/278; 132/279; 24/510

[58] Field of Search ..... 132/273, 274, 132/275, 276, 277, 278, 279, 280; 24/511, 510, 556

[56] References Cited

U.S. PATENT DOCUMENTS 5,642,740 7/1997 Chen ..... 132/277

5,735,296 4/1998 Chen ..... 132/277

*Primary Examiner*—John J. Wilson
*Assistant Examiner*—Trang Doan
*Attorney, Agent, or Firm*—Rosenberg, Klein & Bilker

[57] ABSTRACT

A hair clip includes two bristle members pivotally connected by a pin. Each bristle member includes a grasp section and a bristle section, and an elastic member is mounted around the pin to bias the bristle sections of the two bristle members toward each other. A flexible connecting member is interconnected between the grasp sections of the bristle members and has a section which is stretchable to form an opening through which the elastic member is passable.

2 Claims, 8 Drawing Sheets

HAIR CLIP

BACKGROUND OF THE INVENTION

The present invention relates to a hair clip having a flexible connecting member to shield the spring of the hair clip without adversely affecting assembly of the hair clip.

A typical hair clip is shown in FIG. 10 of the drawings and includes two members 1' and 2' pivotally connected by a pin 4' and a spring 3' for biasing bristle sections of the members 1' and 2' to move toward each other to achieve the hair clip function. Each member 1', 2' includes a grasp section 11', 21', and an inner side of each grasp section 11', 21' has a pair of lugs 12', 22' formed thereon. The pin 4' is extended through pin holes 13', 23' defined in the lugs 12', 22', and the spring 3' is mounted between the lugs 12'. The spring 3' is exposed and thus cannot provide an aesthetic outlook. The present invention is intended to provide an improved hair clip to solve this problem.

SUMMARY OF THE INVENTION

In accordance with one aspect of the invention, a hair clip comprises two bristle members pivotally connected by a pin. Each bristle member includes a grasp section and a bristle section, and an elastic member is mounted around the pin to bias the bristle sections of the two bristle members toward each other. A flexible connecting member is interconnected between the grasp sections of the bristle members and has a section which is stretchable to form an opening through which the elastic member is passable.

In an embodiment of the invention, each bristle member includes a tube, and the flexible connecting member includes two ends respectively received in the tubes on the bristle members.

Other objects, advantages, and novel features of the invention will become more apparent from the following detailed description when taken in conjunction with the accompanying drawings.

DESCRIPTION OF THE PREFERRED EMBODIMENTS

Figure 1:
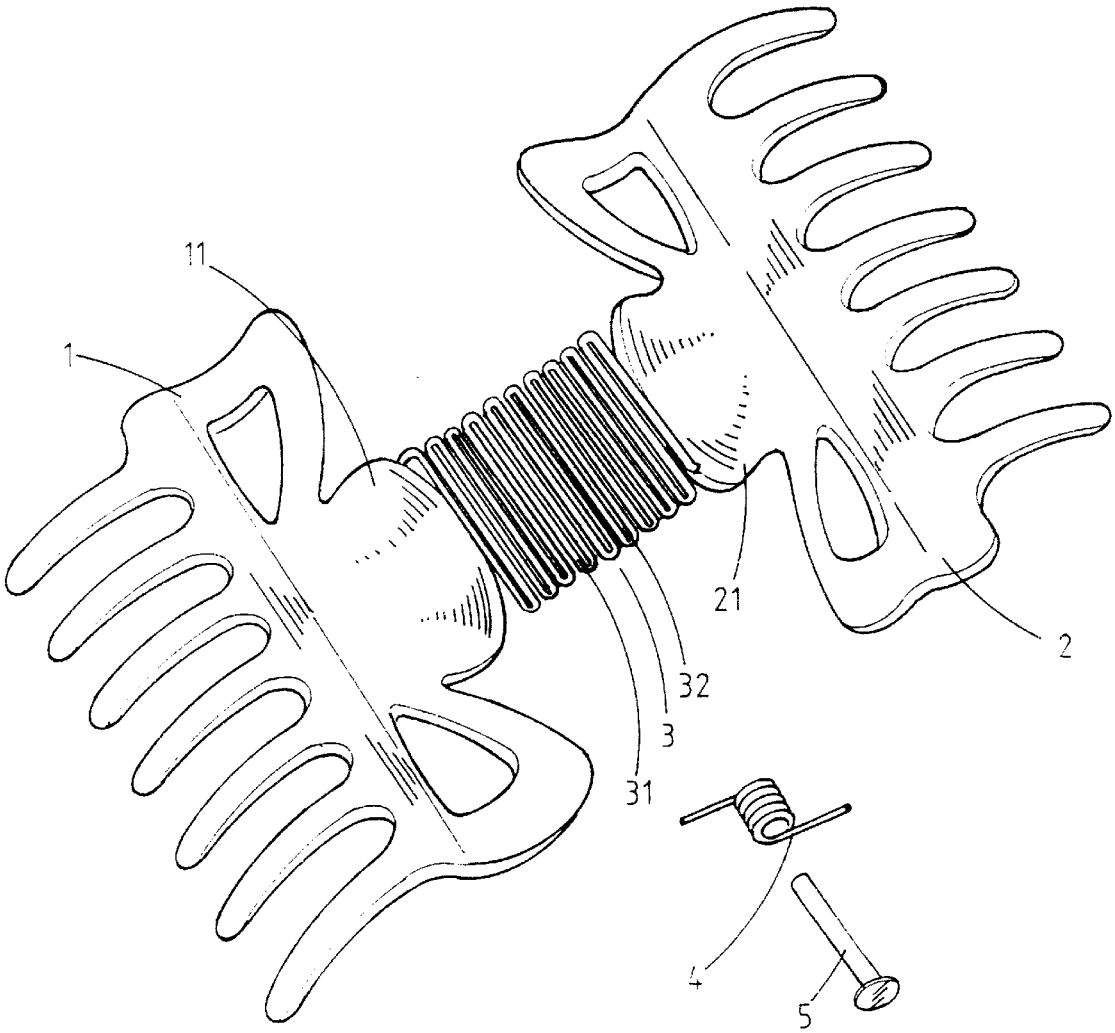
FIG. 1 is an exploded perspective view of a hair clip in accordance with the present invention.
Figure 2:
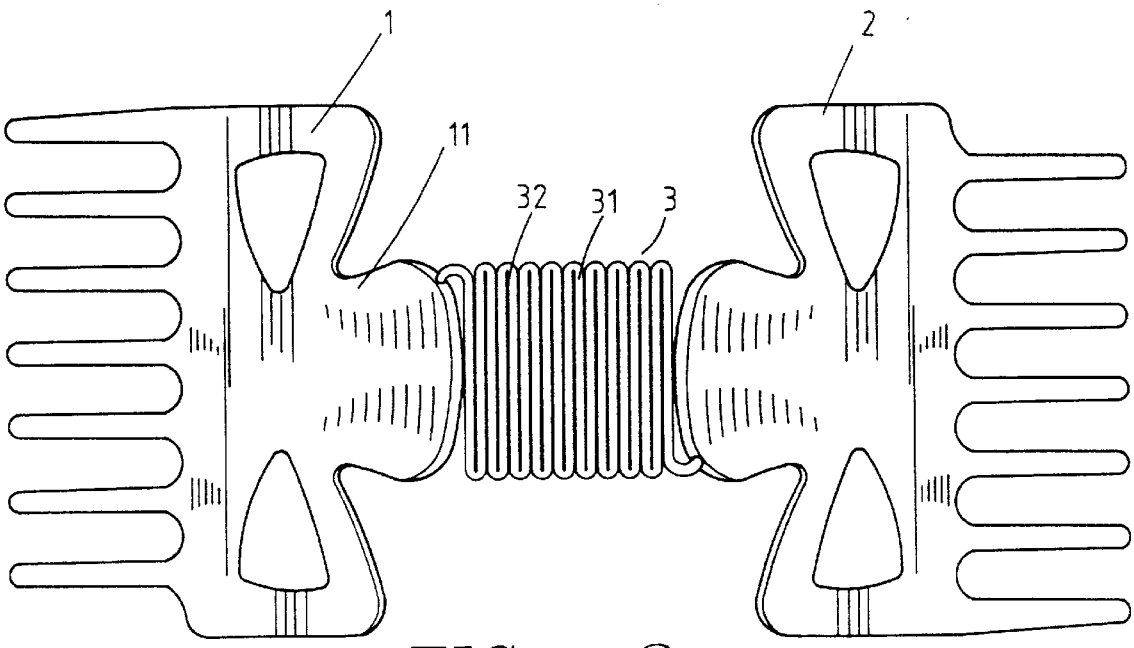
FIG. 2 is a top plan view illustrating the hair clip in FIG. 1 in a flattened status.
Figure 3:
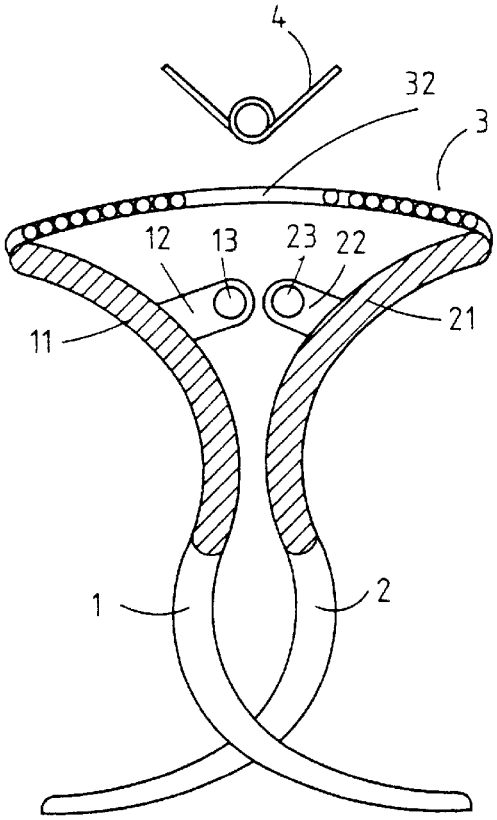
FIG. 3 is a side view, partially sectioned, illustrating assembly of an elastic member of the hair clip in FIG. 1.
Figure 4:
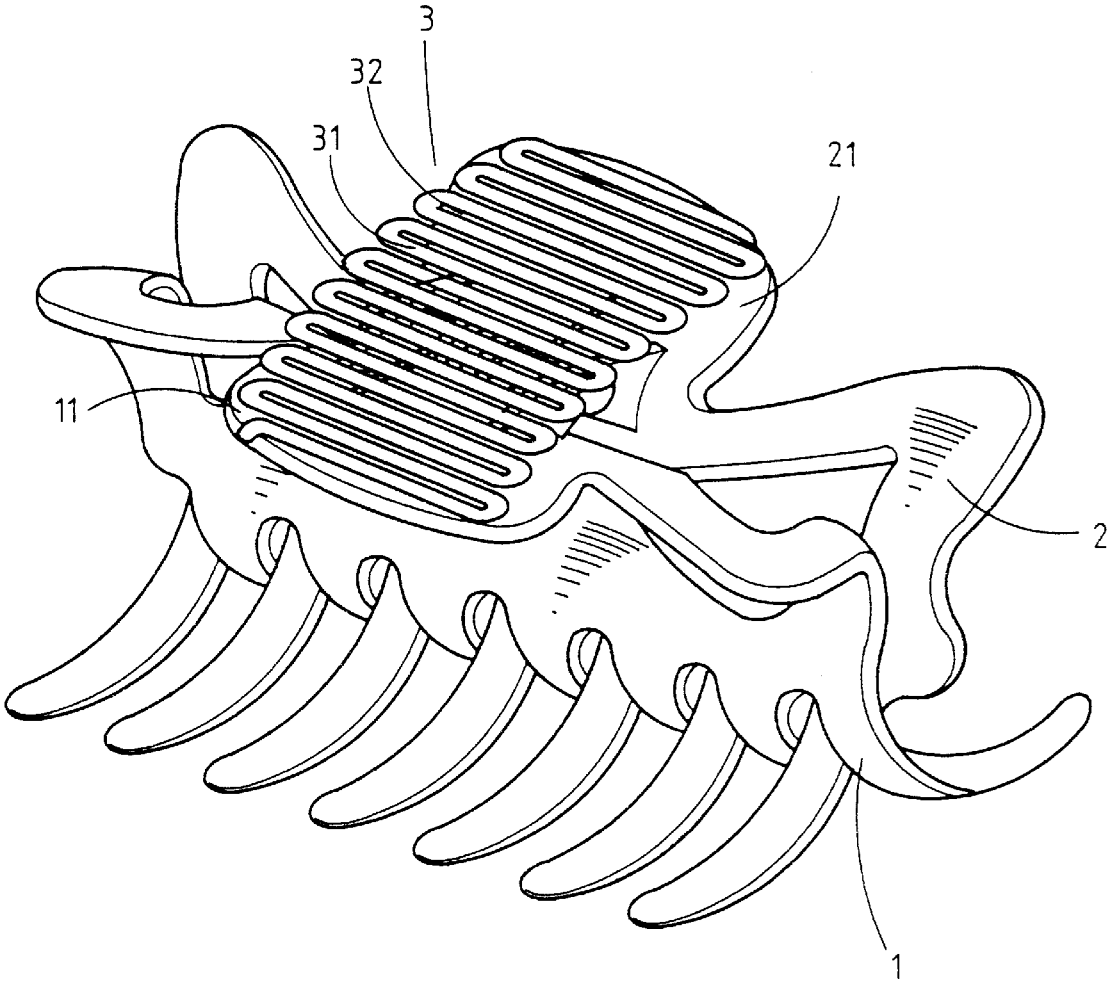
FIG. 4 is a perspective view of the hair clip in FIG. 1.
Figure 5:
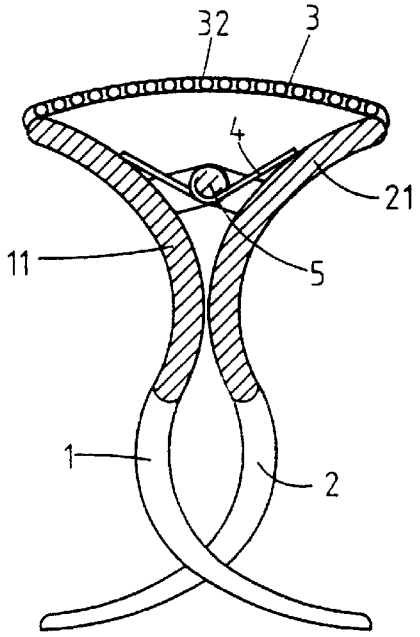
FIGS. 5 and 6 are side views, partially sectioned, illustrating operation of the hair clip in FIG. 1.

Referring to FIGS. 1 to 9 and initially to FIGS. 1, 2, and 4, a hair clip in accordance with the present invention includes two bristle members 1 and 2 pivotally connected by a pin 5. Each bristle member 1, 2 includes a bristle section (not labeled) which is conventional and therefore not described in detail. Each bristle member 1, 2 further includes a grasp section 11, 21, and a flexible connecting member 3 is interconnected between the grasp sections 11 and 21. As shown in FIG. 3, an inner side of each grasp section 11, 21 includes a pair of lugs 12, 22 (only one is shown), each lug 12, 22 having a hole 13, 23 defined therein, and the pin 5 is extended through aligned holes 13, 23. An elastic member, e.g, a spring 4 is mounted around the pin 5 to bias the bristle sections of the bristle members 1 and 2 to move toward each other to provide the required hair clip function. The flexible connecting member 3 has a width smaller than that of the bristle member 1, 2, and two ends of the flexible connecting member 3 are respectively, securely attached to the grasp sections 11, 21 of the bristle members 1, 2. In addition, the flexible connecting member 3 includes a mediate section 31 which is stretchable along a longitudinal direction thereof to provide an opening 32 through which the elastic member 4 is passable (FIG. 3).

In assembly, as shown in FIGS. 3 and 4, after the lugs 12, 22 on the bristle members 1, 2 have been aligned with each other, the mediate section 31 of the flexible connecting member 3 is stretched to form the opening 32 so as to allow the elastic member 4 to be extended through the opening 32 and thus placed between the two innermost aligned lugs 12 or 22 for subsequent insertion of the pin 5 into the holes 13 and 23.

Figure 6:
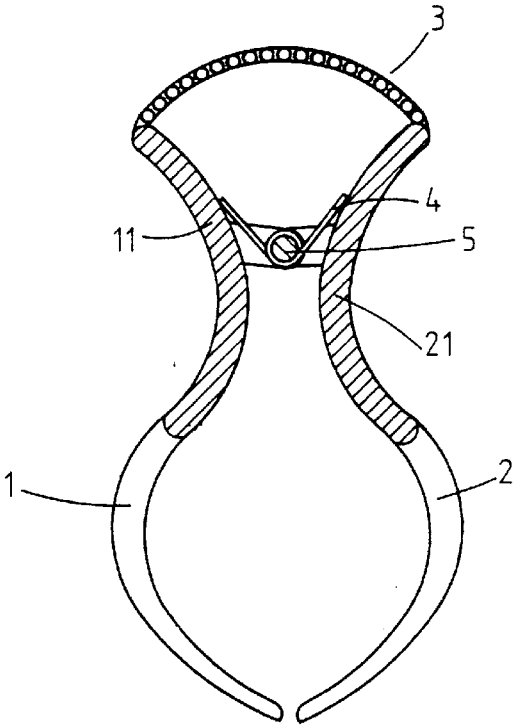

In use, the elastic member 4 is always shielded by the flexible connecting member 3 no matter the hair clip is in a closed status (FIG. 5) or open status (FIG. 6). The connecting member 3 is flexible and thus does not adversely affect the operation of the hair clip.

Figure 7:
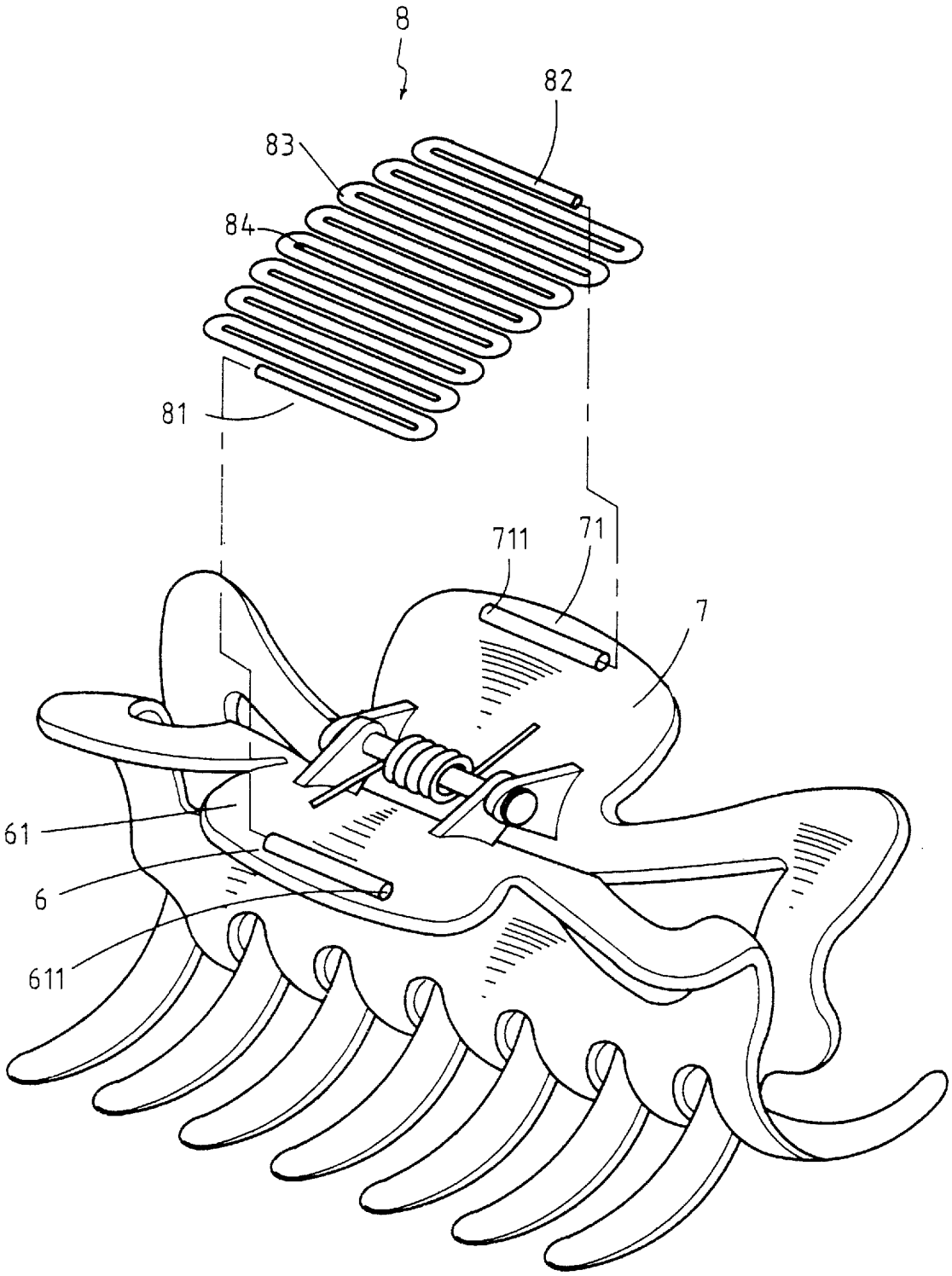
FIG. 7 is a perspective view, partially exploded, of a second embodiment of the hair clip in accordance with the present invention.
Figure 8:
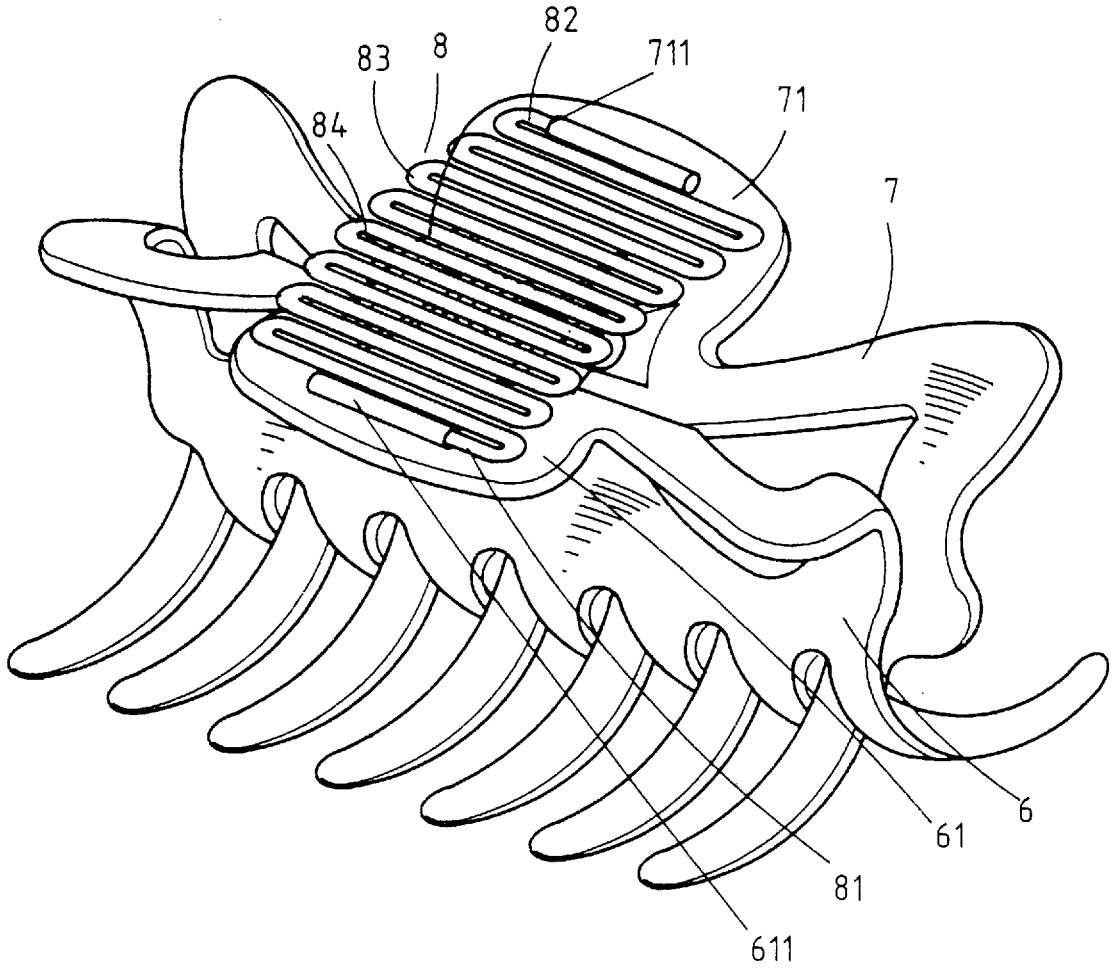
FIG. 8 is a perspective view of the hair clip in FIG. 7.
Figure 9:
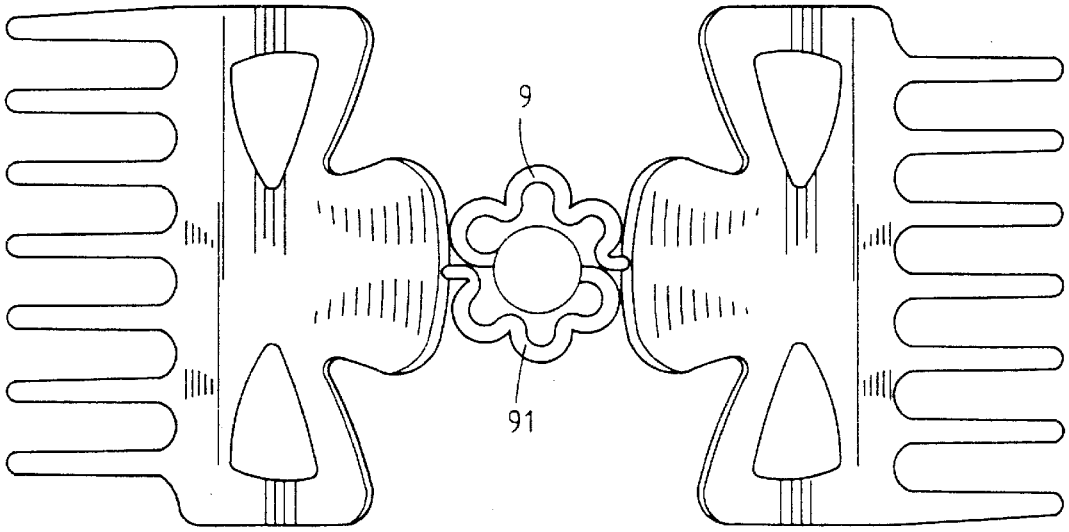
FIG. 9 is a top plan view of a third embodiment of the hair clip in accordance with the present invention.
Figure 10:
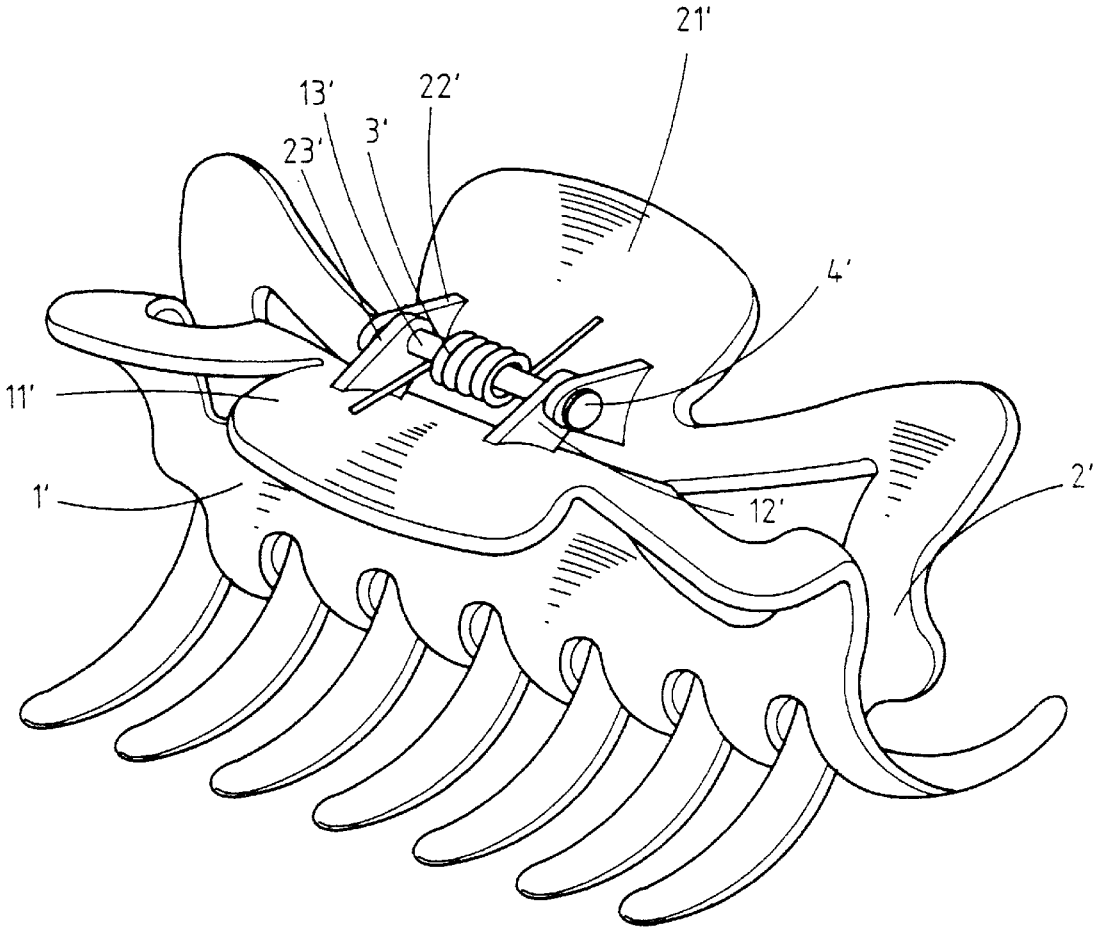
FIG . 10 PRIOR ART
FIG. 10 is a perspective view of a prior art hair clip.

FIG. 7 illustrates a second embodiment of the invention, in which the hair clip includes two bristle members 6 and 7 each having a tube 61, 71 formed on an inner side thereof. Each tube 61, 71 includes a hole 611, 711 defined therein for respectively receiving two ends 81 and 82 of a flexible connecting member 8. Like the arrangement in the above embodiment, an opening 84 defined in a mediate section 83 of the flexible connecting member 8 is also expandable to allow insertion of the elastic member 72. FIG. 9 illustrates a third embodiment of the hair clip in a flattened status, in which the flexible connecting member 9 includes a flexible section 91 with a good-looking outline.

It is appreciated that the flexible connecting member can be securely attached to the grasp sections of the bristle members by any suitable means.

According to the above description, it is appreciated that the flexible connecting member in accordance with the present invention may shield the elastic member (usually metallic) to provide an aesthetic purpose. In addition, the flexible connecting member and the bristle members may be formed of the same material. Further, the flexible connecting member may be stretched to allow easy mounting of the elastic member. And the flexible connecting member does not adversely affect operation of the hair clip.

Although the invention has been explained in relation to its preferred embodiment, it is to be understood that many other possible modifications and variations can be made without departing from the spirit and scope of the invention as hereinafter claimed.

What is claimed is:

1. A hair clip, comprising: two bristle members pivotally connected by a pin, each said bristle member including a grasp section and a bristle section, an elastic member being mounted around the pin to bias the bristle sections of the two bristle members toward each other, and a flexible connecting member being interconnected between the grasp sections of the bristle members and having a section which is stretchable to form an opening through which the elastic member is passable.

2. The hair clip according to claim 1, wherein each said bristle member includes a tube, and the flexible connecting member includes two ends respectively received in the tubes on the bristle members.

* * * * *